US006603439B2

(12) United States Patent
Ngo Bui Hung et al.

(10) Patent No.: US 6,603,439 B2
(45) Date of Patent: Aug. 5, 2003

(54) RADIATING ANTENNA WITH GALVANIC INSULATION

(75) Inventors: Frédéric Ngo Bui Hung, Franconville (FR); Maurice Elkael, Le Vesinet (FR)

(73) Assignee: Thales, Paris (FR)

( * ) Notice: Subject to any disclaimer, the term of this patent is extended or adjusted under 35 U.S.C. 154(b) by 17 days.

(21) Appl. No.: 10/011,983

(22) Filed: Dec. 11, 2001

(65) Prior Publication Data

US 2002/0109639 A1 Aug. 15, 2002

(30) Foreign Application Priority Data

Dec. 12, 2000 (FR) ..... 00 16160

(51) Int. Cl.[7] ..... H01Q 9/16

(52) U.S. Cl. ..... 343/793; 343/701; 343/727; 343/792; 342/378; 455/561

(58) Field of Search ..... 343/701, 727, 343/792, 793, 829, 841, 846; 342/372, 378, 383; 375/354, 355; 455/126, 127, 522, 561; H01Q 9/16

(56) References Cited

U.S. PATENT DOCUMENTS

| | | | | | |
|---|---|---|---|---|---|
| 5,072,232 | A | * | 12/1991 | Korner | 343/729 |
| 5,349,362 | A | * | 9/1994 | Forbes et al. | 343/720 |
| 5,977,920 | A | | 11/1999 | Hung | 343/715 |
| 6,184,812 | B1 | * | 2/2001 | Younis et al. | 341/143 |
| 6,195,065 | B1 | | 2/2001 | Hung et al. | 343/876 |
| 6,268,774 | B1 | * | 7/2001 | Soumyanath | 330/305 |
| 6,407,702 | B1 | * | 6/2002 | Bergman et al. | 342/364 |
| 6,547,140 | B2 | * | 4/2003 | Marchand | 235/462.01 |

* cited by examiner

*Primary Examiner*—Tho Phan
(74) *Attorney, Agent, or Firm*—Oblon, Spivak, McClelland, Maier & Neustadt, P.C.

(57) ABSTRACT

A dipole antenna with a radiating structure comprises at least one device adapted to the conversion of analog signals into digital signals and/or digital signals into analog signals, said device being positioned in a part of the antenna that is insulated from electromagnetic waves or phenomena The antenna can be used in radiocommunications systems.

11 Claims, 5 Drawing Sheets

FIG.1 PRIOR ART
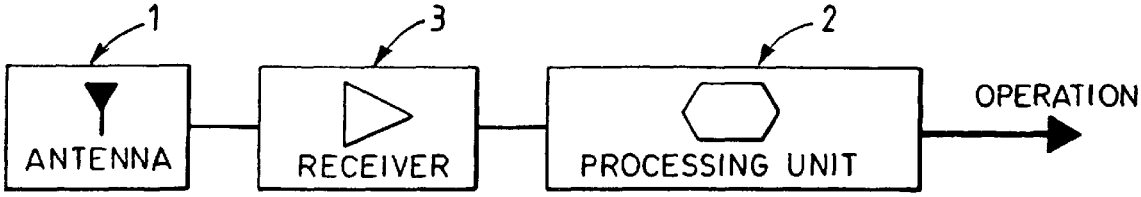
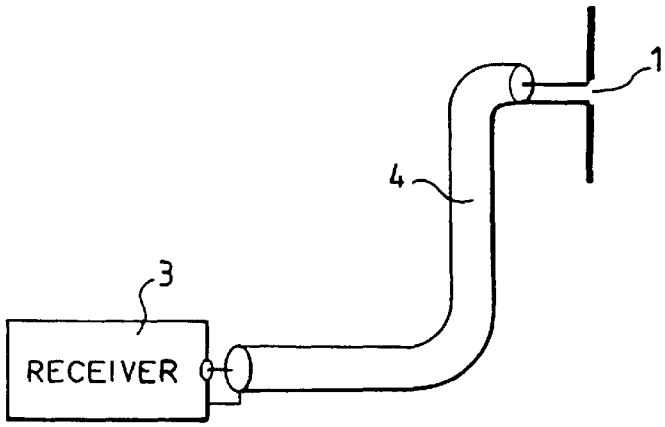
FIG.2 PRIOR ART

RADIATING ANTENNA WITH GALVANIC INSULATION

BACKGROUND OF THE INVENTION

1. Field of the Invention

The present invention relates to an insulated radiating antenna, adapted to the conversion of analog signals into digital signals or vice versa.

It can be used especially in the field of radio communications, for example, as a sender or receiver antenna:

- reception antennas for surface buildings capable of feeding a large number of receivers,
- An elementary antenna of an antenna array of a detection and listening system with highly efficient anti-jamming protection;
- An elementary antenna of an antenna array of a high-resolution direction-finding system.

More generally, it can be applied to all reception systems in which the amplitude and the phase of the useful signals have to be known with high precision. Systems such as this are for example detection and listening systems capable of cancelling out jamming devices, or high-resolution direction-finding or localization systems or again single-antenna multi-receiver reception systems with wide dynamic range.

2. Description of the Prior Art

In the field of radio communications, for example communications comprising listening, detection and localization means, the usual reception systems consist chiefly of the following elements:

- An antenna 1, whose role is to pick up an incident electromagnetic wave and convert it into an electrical signal to be given to the receiver;
- A receiver 3 used to select and insulate the signals known as useful signals,
- A processing unit 2 that shapes the useful signals to be interpreted by the operator. In certain systems, the processing unit forms an integral part of the receiver.

FIG. 2 shows an exemplary prior art connection diagram of the connection between an antenna and a receiver.

The signals picked up by the antenna 1 are transferred to the receiver 3 by an electrically conductive feeder cable 4 which may be a bifilar type of cable or, more usually, a coaxial type of cable. When no precautions are taken during the installation of the antenna and of the cable, unwanted phenomena may appear and disturb the efficient operation of the reception systems, for example by modifying the pick-up capacity of the antenna, or again by introducing an undesirable phase shift in the useful signal to be processed. This defect is all the more pronounced as the system works in a wide range of frequencies, for example in HF (high frequency) reception systems covering the 1.5 MHz–30 MHz range, or as the system uses antennas which are small in relation to the wavelength, or as the antenna is installed at a great distance from the receiver.

Various approaches have been disclosed in the prior art to overcome phase shift defects if any. Some of these approaches are given in FIGS. 3 to 4.

FIG. 3*a*, shows an exemplary dipole antenna where the radio communications receivers 3 have asymmetrical structures. The input of a receiver has a terminal known as a hot terminal 3*a* and a cold or ground terminal 3*b*. This is also the case for the coaxial type feeder cables in which the first end

5*a* of the core has to be connected to the hot terminal 3*a* and the corresponding first end 5*b* of the shielding has to be connected to the ground 3*b* at one of its ends. This is true also for a frame antenna shown in FIG. 3*b*. Now, the structure presented by the majority of the antennas 1, as can be seen in FIGS. 3*a* and 3*b*, is rather a symmetrical structure comprising a pole 1' and a pole 1".

In this case, if the second ends 6*a*, 6*b* of the coaxial cable 4 are connected without precautions to one of the antennas 1 of FIG. 3*a* or FIG. 3*b*, taken for example by connecting the end 6*a* of the core to the pole 1' and the end 6*b* of the shielding to the pole 1" of the antenna, the incident electromagnetic wave to be picked up by the antenna will induce a current $I_g$ known as the <<sheathing current >> on the external skin of the shielding of the coaxial cable, which is added to the current $I_a$ generated by the antenna itself. By Kirchoff's law, the current at the pole 1" of the antenna 1 is equal to the current $I_a$ whereas, at the pole 1', the current is equal to the sum of the currents $I_g$ and $I_a$. It is then necessary to equalize the currents at the two poles 1' and 1" of the antenna to cancel out the sheathing current $I_g$ of the coaxial cable 4 and hence the pick-up capacity of this cable. This symmetrization is obtained for example by means of an adapted device known as a "balun" by those skilled in the art. This balun is placed between the coaxial cable and the antenna.

Furthermore, when the antenna is at a great distance from the receiver, the sheath current $I_g$, even when it is cancelled out at the antenna by the use of a balun, may be substantial in the case of a very long coaxial cable with imperfect shielding, for example a flexible coaxial cable whose shielding consists of a metal braid. This current then induces a parasitic electrical voltage between the core and the shielding of the coaxial cable and this voltage is found naturally at the input of the receiver. This parasitic voltage is proportional to the sheathing current $I_g$ and to the physical length of the coaxial cable. The coefficient of proportionality is an intrinsic characteristic of the coaxial cable used, and is called a "transfer impedance". To overcome this defect, it is necessary to use cables with very low transfer impedance, such as double-braid cables, full-shielded rigid cables that have the drawbacks, in particular, of being costly, cumbersome and subject to constraints In applications using a large number of reception antennas located in one and the same constricted area, for example a ship's mast structure, there are problems of proximity owing to the supply cables. FIG. 4 gives a schematic view of two dipole antennas 1 and I, located one on top of the other for lack of sideways space. It can be seen that the cable 4 of the top antenna 1 masks the radiation of the bottom antenna I to some extent.

The object of the invention relates to an antenna used especially to prevent the above-mentioned effects by isolating it from its environment.

The idea of the invention lies especially in providing an antenna with means adapted to converting the picked-up analog signals into digital signals or digital signals to be sent into analog signals and in having these means available in a part that is insulated from electromagnetic waves and from all disturbing phenomena.

In the case of a receiver antenna, the means for transmitting the signals are chosen so as to transmit the digital signals, generated by the antenna that is the object of this invention, to the receiver with a sufficient bit rate dictated by the application and without making use of links based on electrical conductors that may disturb the operation of the antenna, at least with regard to the essential links between the antenna and the receiver.

SUMMARY OF THE INVENTION

An object of the invention is a dipole antenna with a radiating structure comprising at least one device adapted to the conversion of analog signals into digital signals and/or digital signals into analog signals, said device being positioned in a part of the antenna that is insulated from electromagnetic waves or phenomena.

According to one embodiment, the conversion device comprises, for example, an amplifier stage or an impedance-matching device adapted to the antenna and to the analog-digital converter.

According to a second embodiment, the conversion device may comprise a power stage and a digital-analog converter.

The antenna comprises, for example, a data transmission device integrated into the insulated part, this device possibly being an electrical converter linked with an insulating optic fiber that is transparent to electromagnetic waves.

An object of the invention is also a signal transmission and reception system comprising one or more antennas according to one of the characteristics mentioned here above, each antenna being connected by electrically non-conductive transmission means to at least one receiver.

The antenna comprising one of the above-mentioned characteristics is used for example in radiocommunications systems working in the HF frequency band ranging from 1.5 to 30 MHz.

The antenna according to the invention has the following advantages in particular:

- it eliminates the disturbances caused in the operation by the presence of a "main" link based on electrical conductors between the antenna and the receiver, for example the coaxial cables that are commonly used,
- it can be easily integrated in terms of choice of position, the links between the antenna and the receiver being transparent to electromagnetic waves,
- the antenna elements with galvanic insulation thus constituted have no electrically conductive "main" link either with the electrical ground or with the mechanical ground of the radiocommunications system with which it is connected,
- it can be used to work in a wide range of frequencies, wider than that commonly used in the prior art.

MORE DETAILED DESCRIPTION

Other features and advantages of the invention shall appear from the following description given by way of an illustration that in no way restricts the scope of the invention, wherein:

FIG. 1 is a block diagram of the reception system,

FIG. 2 is an exemplary antenna-to-receiver connection according to the prior art.

MORE DETAILED DESCRIPTION

The following description is given by way of an illustration and in no way restricts the scope of the invention. It pertains to a possible embodiment of the antenna according to the invention using the usual elementary antennas mentioned here above, namely the dipole antenna or the frame antenna. These antennas may be used as transmitters or receivers.

The antenna elements already shown in FIGS. 1 to 4 keep the same references.

Figure 3A:
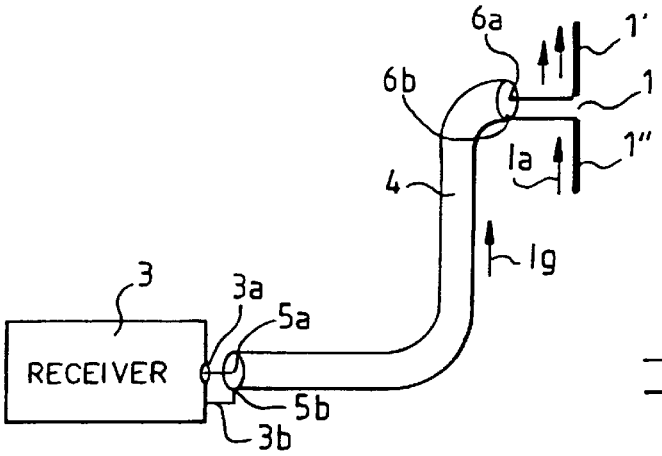
FIG.3a PRIOR ART
FIGS. 3*a*, 3*b* and 4 show exemplary connections of antennas according to the prior art.
Figure 3B:
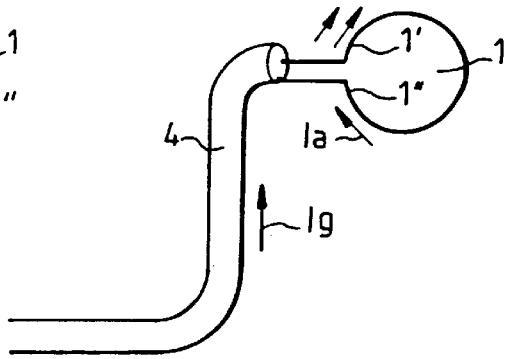
FIG.3b PRIOR ART
Figure 4:
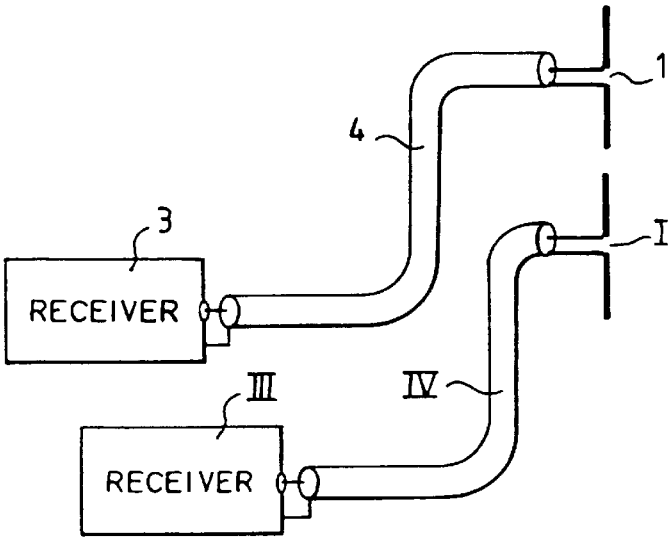
FIG.4 PRIOR ART
Figure 5:
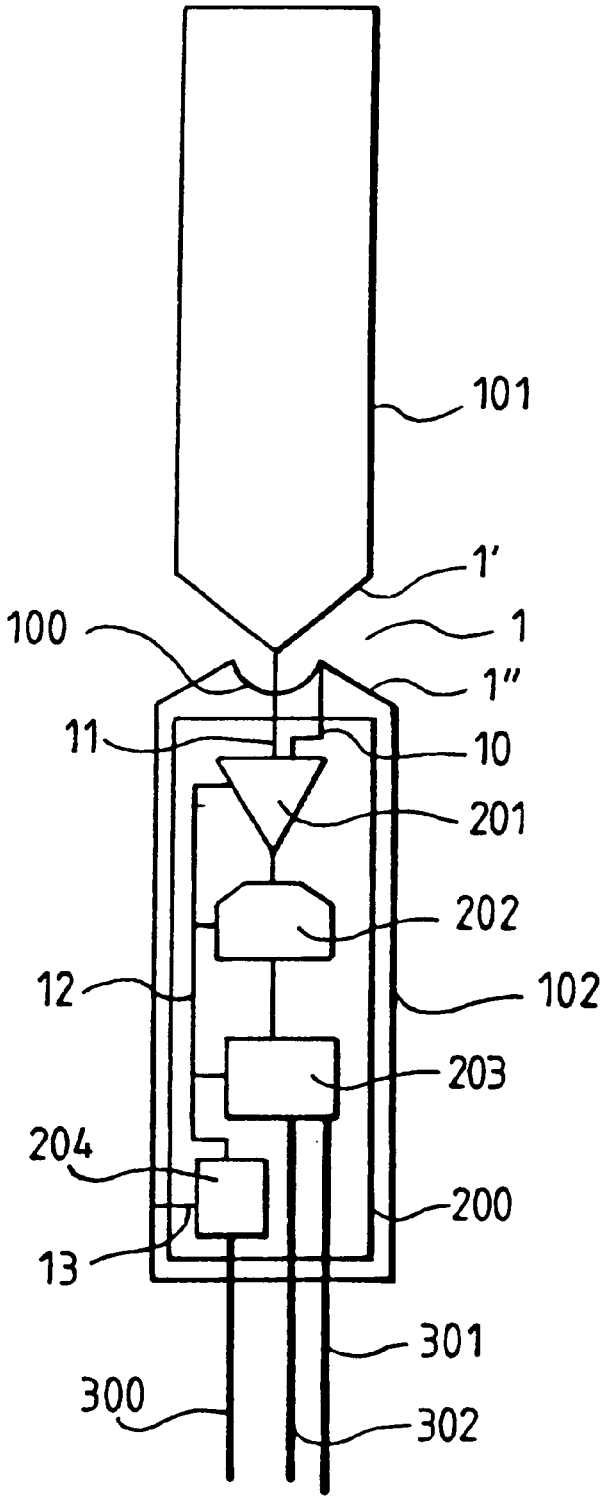
FIG. 5 is a first block diagram of a dipole antenna according to the invention, FIG. 6 a second block diagram representing a frame antenna according to the invention.

FIG. 5 shows a dipole antenna according to the invention. It has a conductive part 102 placed for example in the vicinity of the pole 1" and a part 101 picking up signals received by the antenna.

The conductive part 102 is made as a hollow structure in order to receive a device 200 known as a "digitizer" that is adapted to the conversion of the analog signals picked up by the antenna 1 into digital signals. The digital signals may take a digital form capable of being transmitted by an optic fiber 301 to a receiver not shown in the figure. More generally, the shape taken by the digital signals is adapted to the transmission means used up to the receiver.

The conductive part 102 is preferably made of an electrically very conductive metal and forms an electromagnetic shielding for the digitizer 200 while at the same time forming part of the pick-up structure of the antenna.

The digitizer 200 consists for example essentially of the amplifier and adapter stage 201, an analog-digital converter (ADC) 202 that converts analog signals delivered by the amplifier stage 201 into digital signals and a data transmission device 203. The data transmission device 203 is for example an electrical/optical converter used to transmit digital information by an optic fiber 301 to a receiver that may be at the distance of several kilometers from the antenna. The constitution of the stage 201 is known to those skilled in the art and shall not be given in detail in the description. The stage 201 is made so that its input characteristics are adapted to the type of antenna 1 used and so that its output characteristics are compatible with the requirements of the ADC used. This is also be the case for the analog-digital converter 202 and for the transmission device 203 which is fitted out with appropriate interface circuits, for example a parallel-series interface to adapt to the output of the ADC 202 if this ADC is a parallel output device, or any other element needed for operation.

In another exemplary embodiment, the transmission device 203 may be positioned outside the conductive part at a distance close enough to avoid problems of disturbance resulting from the electrically conductive linking element.

The signals picked up by the antenna 1 are applied to the two input terminals of the stage 201. Of these two input terminals, one is connected to the port 1' of the antenna 1 by an electrical connection wire 11, which crosses the element 102 by a small-sized hole 100 so as not to disturb the shielding effect. The other input terminal is connected to the pole 1" by an electrical linking wire 10

The electrical power needed for the working of the digitizer 200 is given by an energy source 204 which may be a power cell, a rechargeable battery or, preferably, a photoelectric cell powered by the light energy of a laser (not shown here for the clarity of the description) provided by an optic fiber 300. An electrical cable 12 is used to distribute the energy delivered by the source 204 to the various components of the digitizer 200. The zero potential is referenced to that of the shielding element 102 by connecting the ground of the source 204 to this shielding element 102 by means of the electrical link 13.

The clock pulses needed for the operation of the ADC 202 and of the electrical/optical converter 203 maybe generated internally in the digitizer 200. However, they may preferably be conveyed by the optic fiber 302 from a single clock, in a separate location, providing for perfect synchronism between several antennas of one and the same radiocommunications system.

Figure 6:
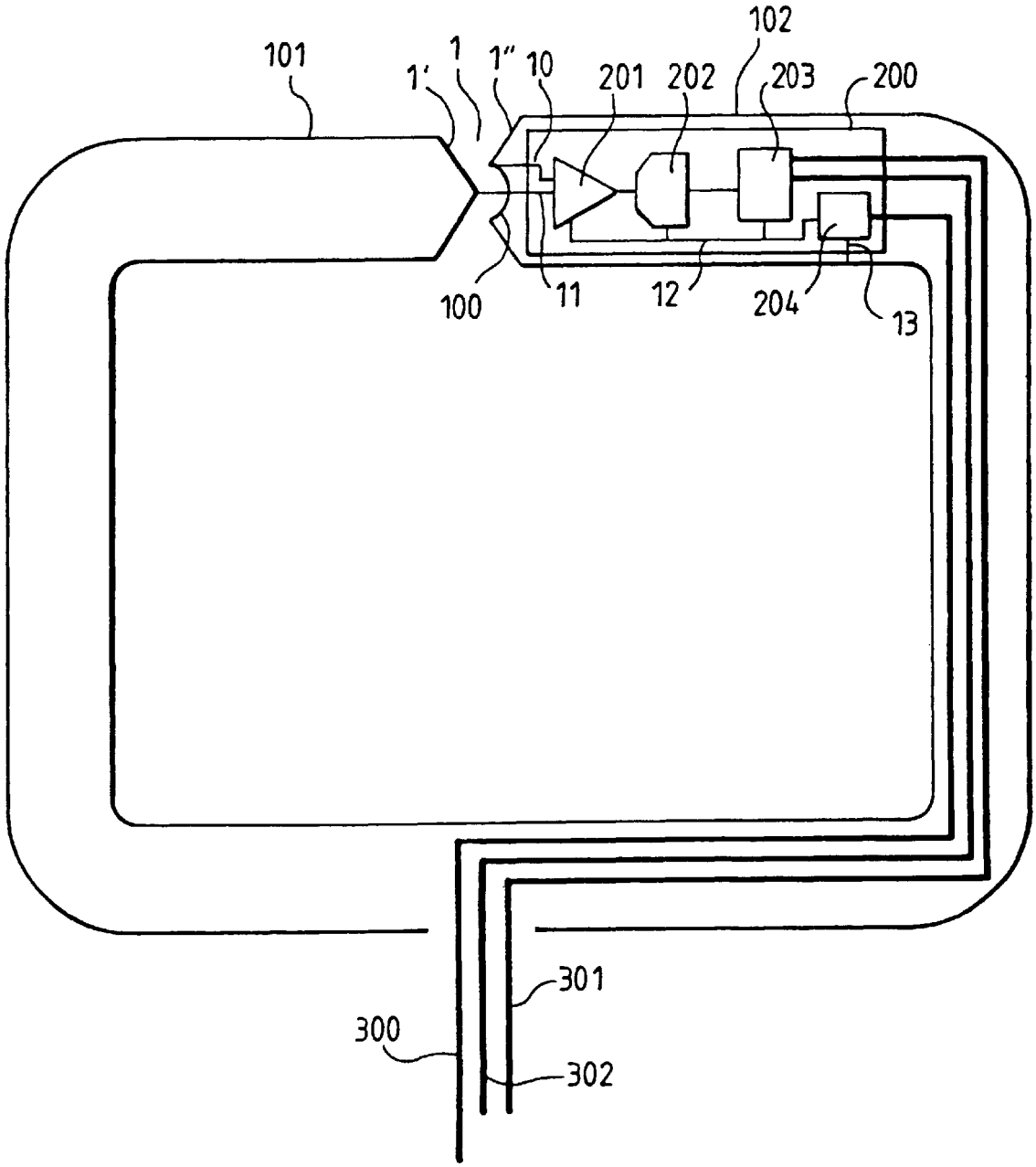

FIG. 6 shows an alternative embodiment of the invention applied to a frame antenna comprising elements identical to those used to describe the dipole antenna of FIG. 5. The difference lies chiefly in the layout of the two poles 1' and 1" of the antenna. To understand the structure and working of an antenna such as this, the reader may refer to the description of FIG. 5.

Figure 7:
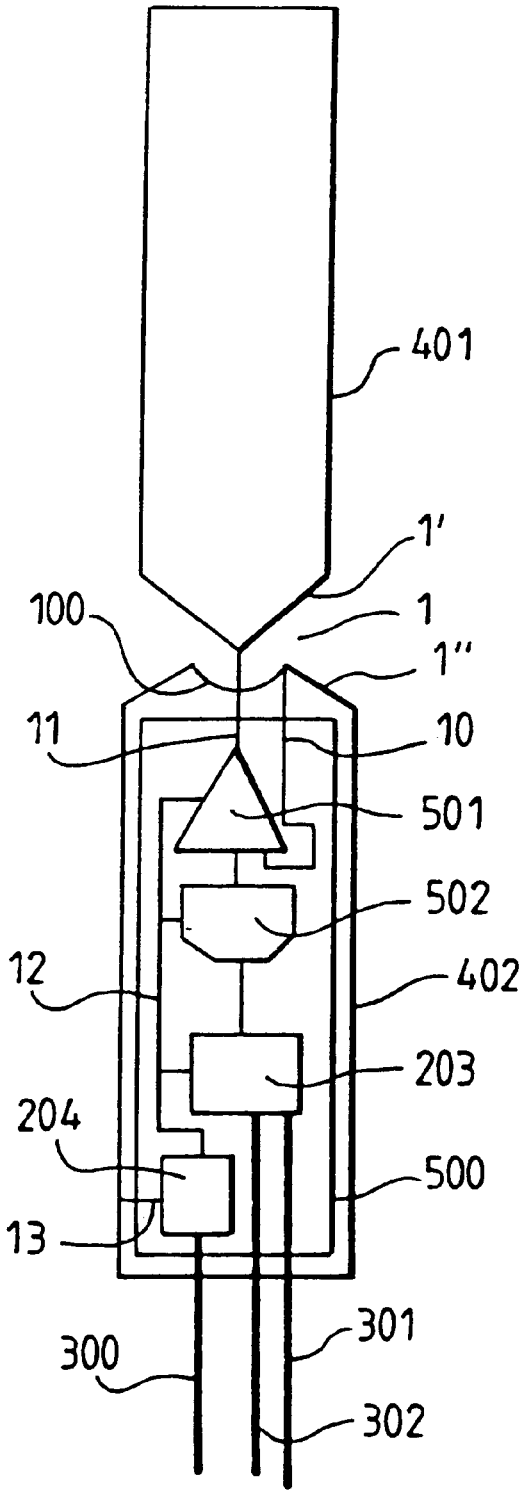
FIG. 7 shows an exemplary structure of a sender antenna.

FIG. 7 gives a schematic view of an antenna structure used as a transmitter.

The antenna 1 has a sender part 401 and an electricity-conducting part 402. The device used to convert the digital signals received by the antenna is referenced 500 in the figure and has a transmission line consisting for example of the digital-analog converter or DAC 502 and a power amplifier 501. The antenna also has a data transmission device 203, a device 204 giving the energy required for the working of the assembly, as well as links such as optic fibers 300, 301 and 302, used to convey the digital signals up to the antenna to supply the energy-supplying device 204. These elements bear references identical to those given in FIGS. 5 and 6.

The digital information to be sent is conveyed up to the antenna by means of the optic fiber 301 for example and are received by the transmission device 203. The signals are then converted into analog signals by the DAC 502 and then amplified by the power amplifier 501. The amplified analog signals are then transmitted to the sender part 401 of the antenna.

The conductive part 402 has characteristics similar to those of the conductive part 102 of FIG. 5 and constitutes an electromagnetic shielding for the signal conversion device 500.

The characteristics of the positioning of the different elements with respect to one another or with respect to the poles of the antenna are similar to those given in FIGS. 5 and 6.

According to another embodiment, the sender antenna is a frame antenna, not shown.

Without departing from the framework of the invention, the optic fibers used to transmit or convey signals towards or to the antenna may be replaced by any other means capable of transmitting the digital information obtained with a sufficient bit rate fixed by the desired application, such as infrared beams or microwave beams.

What is claimed is:

1. A dipole antenna with a radiating structure comprising at least one device adapted to the conversion of analog signals into digital signals and/or digital signals into analog signals, said device being positioned in a part of the antenna that is insulated from electromagnetic waves or phenomena.

2. An antenna according to claim 1 wherein the conversion device comprises an amplifier stage or an impedance-matching device adapted to the antenna and to the analog-digital converter.

3. An antenna according to claim 1 wherein the conversion device comprises a power stage and a digital-analog converter.

4. An antenna according to one of the above claims wherein the device adapted for converting the signals is integrated into the insulated part of the antenna, positioned in the vicinity of one of the two poles.

5. An antenna according to one of the claims 1 to 4, comprising a data transmission device integrated into the insulated part.

6. An antenna according to claim 5 wherein the data transmission device is an electrical converter linked to an insulating optic fiber and transparent to the electromagnetic waves.

7. An antenna according to one of the claims 1 to 6, comprising a device for the supply of electrical energy given by a photovoltaic cell.

8. A system for the transmission or reception of signals comprising one or more antennas according to one of the claims 1 to 7, each antenna being connected by electrically non-conductive means of transmission to at least one receiver.

9. A system according to claim 8 comprising a data transmission device that is an electrical converter linked to an insulating optic fiber and transparent to the electromagnetic waves.

10. A system according to claim 8 comprising data transmission device connected to a supply of electrical energy given by a photovoltaic cell supplied by an optic fiber.

11. Use of an antenna according to one of the claims 1 to 7 for radiocommunications systems working in the HF frequency band ranging from 1.5 to 30 MHz.

* * * * *